United States Patent [19]

Bogdanov et al.

[11] Patent Number: 4,867,322

[45] Date of Patent: Sep. 19, 1989

[54] BALL TUBE MILL

[76] Inventors: Vasily S. Bogdanov, ulitsa Kostjukova, 36, kv. 103, Belgorod; Alexandr D. Netesin, ulitsa Lenina, 28, kv. 65, Stary Oskol; Ivan I. Miroshnichenko, ulitsa Kostjukova, 36, kv. 63; Nikolai S. Bogdanov, bulvar Pervogo Saljuta, 4, kv. 84, both of Belgorod; Vladimir B. Khlusov, ulitsa Berzarina, 10, korpus 2, kv. 39, Moscow; Viktor S. Platonov, ulitsa Lenina, 52a, kv. 10; Ivan N. Shevchenko, ulitsa Dovatora, 62, kv. 68, both of Cherkessk, all of U.S.S.R.

[21] Appl. No.: 216,519

[22] Filed: Jul. 8, 1988

[51] Int. Cl.[4] ..... B02C 17/06

[52] U.S. Cl. ..... 241/72; 241/183

[58] Field of Search ..... 241/176–183, 241/72, 153, 299, 284

[56] References Cited

U.S. PATENT DOCUMENTS 1,153,844 9/1915 Hansen et al. ..... 241/183

1,309,210 7/1919 Marcy ..... 241/183 X 1,683,627 9/1928 Read ..... 241/72

FOREIGN PATENT DOCUMENTS 308822 3/1918 Fed. Rep. of Germany ..... 241/182

733727 5/1980 U.S.S.R. .

739578 6/1954 United Kingdom ..... 241/182

*Primary Examiner*—Mark Rosenbaum

*Attorney, Agent, or Firm*—Lilling & Greenspan

[57] ABSTRACT

A ball tube mill includes a rotatable housing with a lined inside surface and end cover plates having an inlet hole and an outlet hole and accommodating at an angle to its longitudinal axis at least one perforated wall dividing the housing into coarse and fine grinding chambers charged with grinding bodies. The lined inside surface of the chambers has the form of truncated cones facing by their large bases the perforated wall, the angle of inclination of a generating line of the truncated cones equalling the angle of the slope of the grinding bodies present in the respective chamber, the volume of the coarse grinding chamber being smaller than the volume of the fine grinding chamber.

5 Claims, 4 Drawing Sheets

BALL TUBE MILL

BACKGROUND OF THE INVENTION

1. Field of the Invention

This invention relates generally to the art of comminuting hard materials, and more particularly to ball tube mills.

The invention can find application in the cement industry, in mining, and for other industrial uses, where fine grinding of materials is essential.

2. Description of the Prior Art

There is known a ball tube mill comprising a rotatable housing with a lined inside surface and end bottom plates having inlet and outlet holes. Arranged inside the housing at an angle to its longitudinal axis is a perforated wall dividing the interior of the housing into coarse and fine grinding chambers. The inside surface of the lining of the housing in the two grinding chambers is cylindrical in shape (cf., SU, A, 733,727).

In the above ball tube mill having a cylindrical lining of the inside surface of the housing the grinding bodies are forced to move from the perforated wall by the plane of this wall.

In the reverse direction (viz., to under the perforated wall), the grinding bodies move spontaneously less vigorously. As a result, the grinding bodies fail to uniformly occupy the entire volume of the grinding chambers of the mill. This is caused essentially because the surface formed by the grinding bodies present in each grinding chamber of the mill substantially extends in the direction of the longitudinal axis of the housing at an angle equal to the slope of the grinding bodies.

The inclination of the surface of the grinding bodies (angle of slope) corresponds to the direction of inclination of the perforated wall and changes during the cycle to the opposite direction.

Non-uniform utilization of the working volume of each grinding chamber generally results in reduced efficiency of the grinding process.

SUMMARY OF THE INVENTION

The object of the present invention is to increase the efficiency of grinding hard materials.

The object of the invention is attained by a ball tube mill comprising a rotatable housing with a lined inside surface and end cover plates having inlet and outlet holes and accommodating at an angle to its longitudinal axis at least one perforated wall dividing the housing into coarse and fine grinding chambers charged with grinding bodies. According to the invention, the lined inside surface of the grinding chambers has the form of truncated cones facing by their large bases the perforated wall, the angle of inclination of a generating line of the truncated cones equalling the angle of the slope of the grinding bodies present in the respective grinding chamber, the volume of the coarse grinding chamber being smaller than the volume of the fine grinding chamber.

Preferably, the lined inside surface of each grinding chamber is defined by successively arranged portions with the angle of inclination of each such portion being preferably greater than the angle of slope of the grinding bodies present on the respective portion, each successive portion forming with the preceding portion a ledge, whereas the angle of inclination of a common generating line of the portions being substantially equal to the angle of slope of the grinding bodies present in the respective grinding chamber.

This arrangement of the lined inside surface of each grinding chamber invigorates the movement of the grinding bodies to under the perforated wall, whereby the working volume of the grinding chambers under the perforated wall is utilized more completely.

Advisably, provided on the lined inside surface of each grinding chamber in the zone of its longer portion at half of its cross-section are projections extending lengthwise of the chamber.

The thus arranged projections on the lined inside surface ensure stable operating conditions of the grinding bodies throughout the cycle at any point of each grinding chamber in cross-section of the truncated cone.

Preferably, the axis of symmetry of the lined inside surface of each grinding chamber is offset relative to the longitudinal axis of the housing toward the shorter portion of the respective grinding chamber.

The thus arranged lined inside surface of each grinding chamber invigorates the comminution process, ensures uniform loads exerted on the bearings of the ball tube mill during the cycle, and makes the mill more reliable in operation.

Alternatively, the fine grinding chamber accommodates a vertical annular perforated wall plate spaced at a distance of not more than one diameter of the housing from the perforated wall at the side of the shorter portion of this chamber, whereas the diameter of an inside hole in the annular perforated wall plate amounts to 0.2–0.4 the diameter of the housing.

The use of the annular perforated wall plate makes the comminution process more efficient when balls and cylinders are used as the grinding bodies.

In view of the foregoing, the ball tube mill according to the invention provides a more vigorous movement of the grinding bodies longitudinally and transversely of the housing of the mill due to the forced movement of the grinding bodies to the space under the perforated wall; the working volume of each grinding chamber of the housing of the mill is utilized more completely; the process of comminution is intensified; and the perforated wall and mill drive means function more reliably.

BRIEF DESCRIPTION OF THE DRAWINGS

The invention will now be described in greater detail with reference to various preferred embodiments thereof taken in conjunction with the accompanying drawings, in which.

DESCRIPTION OF THE PREFERRED EMBODIMENTS

Figure 1:
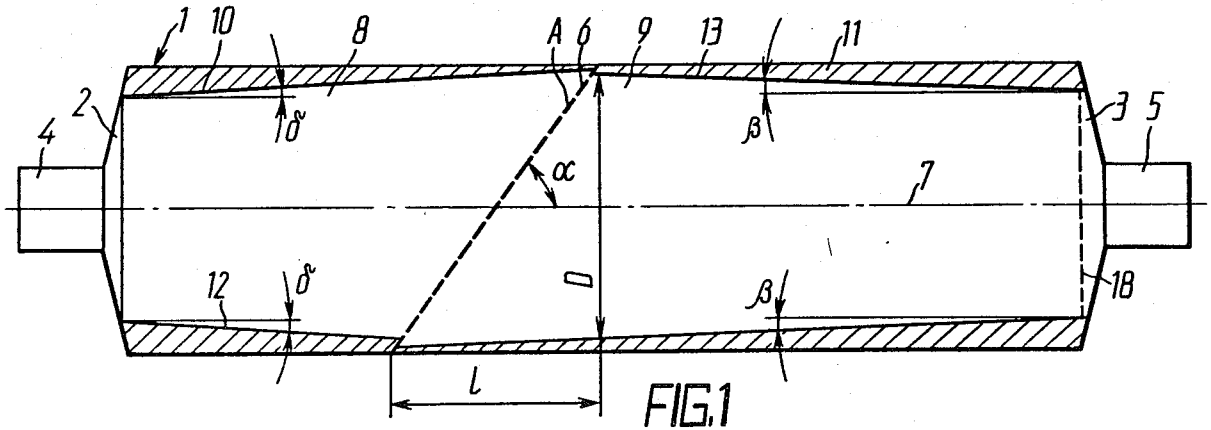
FIG. 1 is a longitudinal sectional view of a ball tube mill according to the invention.

A ball tube mill, hereinafter referred to as the mill, comprises a housing 1 (FIG. 1) closed at the ends by end walls or cover plates 2 and 3. The cover plate 2 has an inlet hole 4. The cover plate 3 is provided with an outlet (discharge) hole 5. Arranged inside the housing 1 at an angle $\alpha$ to a longitudinal axis 7 of this housing is a perforated wall 6. The perforated wall 6 divides the housing 1 into coarse and fine grinding chambers 8 and 9, respectively. The inside of the housing is lined with armour plates defining truncated cones 10, 11. The lined inside surface of each chamber 8 and 9 is fashioned as truncated cones having their large bases facing the perforated wall 6.

A generating line 12 of the truncated cone 10 of the lined inside surface of the chamber 8 is positioned at an angle $\delta$ to the longitudinal axis 7 of the housing 1 which is substantially equal to the angle of slope of grinding bodies (not shown) present in the coarse grinding chamber 8.

A generating line 13 of the truncated cone 11 of the lined inside surface of the chamber 9 is at an angle $\beta$ to the longitudinal axis 7 of the housing 1 which is substantially equal to the angle of slope of the grinding bodies (not shown) present in the fine grinding chambers 9.

For attaining equal capacity of the two chambers 8 and 9 of the proposed ball tube mill the coarse grinding chamber 8 is of a smaller volume than the fine grinding chamber 9.

In order to intensify the longitudinal (reciprocating) movement of the grinding bodies, the lining of the inside surface of the coarse grinding chamber 8*a* (FIG. 2) is formed by circular tapered portions 14 each of which has the form of a truncated cone and the angle $\delta_1$ of inclination of a generating line 15 of each of these portions is greater than the angle $\delta$ of slope of the grinding bodies present in this chamber.

The portions 14 have equal length and diminish in height in the direction from the cover plate 2 to the perforated wall 6. A line 12*a* drawn through tops of the circular tapered portions 14 is at an angle $\delta$ to the longitudinal axis 7 of the housing 1 substantially equal to the angle of slope of the grinding bodies present in the chamber 8*a*.

In order to invigorate the longitudinal movement of the grinding bodies in the chamber 9*a*, the lining on its inner surface is formed by circular tapered portions 16 each having the shape of a truncated cone, an angle $\beta_1$ of inclination of a generating line 17 of each such cone being greater than the angle $\beta$ of slope of the grinding bodies present in this chamber.

The portions 16 have equal length and have a height diminishing in the direction from the cover plate 3 to the perforated wall 6. A line 13*a* drawn through the tops of the tapered circular portions 16 is at an angle $\beta$ to the longitudinal axis 7 of the housing 1 substantially equal to the angle of slope of the grinding bodies present in the chamber 9*a*.

A grid 18 is provided in front of the outlet hole 5 in the fine grinding chamber 9 acting to prevent the escape of the grinding bodies and large-size particles of the material being comminuted from the housing 1.

Figure 3:
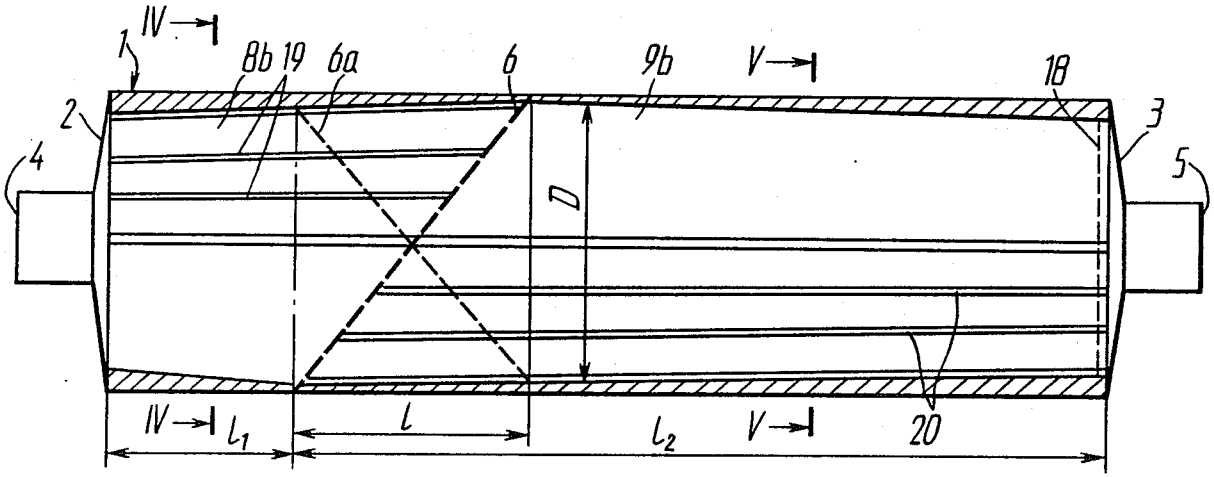
FIG. 3 is a longitudinal sectional view of a ball tube mill having projections at the lined inside surface.
Figure 5:
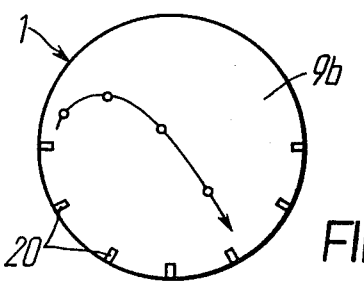
FIG. 5 is a section taken along the line V—V in FIG. 3.
Figure 4:
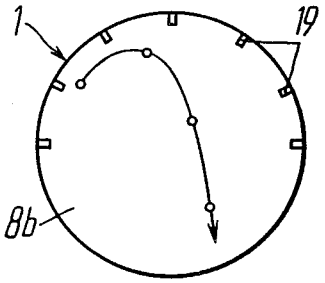
FIG. 4 is a section taken along the line IV—IV in FIG. 3.

For ensuring a stable operation of the grinding bodies across the housing 1 the lined surface of the coarse grinding chamber 8*b* (FIGS. 3 and 4) has projections 19 arranged in the elongated part of the chamber 8*b* through half the cross-section of the housing 1 as shown in FIG. 3. The lined surface of the fine grinding chamber 9*b* also has projections 20 arranged on the elongated part of this chamber 9*b* through half the cross-section of the housing 1 (FIG. 5). The projections 19 (FIG. 3) inside the chamber 8*b* are arranged at the inner surface of the housing 1 opposite to the projections 20 provided in the chamber 9*b*.

The projections 19 in the chamber 8*b* extend from the cover plate 2 to the wall 6. The projections 20 inside the chamber 9*b* extend from the cover plate 3 to the wall 6.

In order to still further invigorate the process of comminution and ensure that uniform loads are exerted throughout the cycle on bearings 21 (FIGS. 6 and 7), the longitudinal axis 22 of the surface of the lining of the truncated cone 23 is offset a distance "e" (FIGS. 6 and 8) relative to the longitudinal axis 7 of the housing 1 toward the side of the shorter part of the chamber 24. The longitudinal axis 25 of the truncated cone 26 in the chamber 27 is offset toward the shorter part of the chamber 27 to a distance "e".

The longitudinal axis 25 of the truncated cone 26 is offset relative to the longitudinal axis 7 of the housing 1 to a side different with respect to the longitudinal axis 22 of the truncated cone 23.

The axes 22 and 25 are offset due to varying the thickness of the lining in each of the chambers 24, 27. The lining of the shorter part of each such chamber 24, 27 has a thickness substantially less than that of the longer part of the chambers 24, 27.

Figure 7:
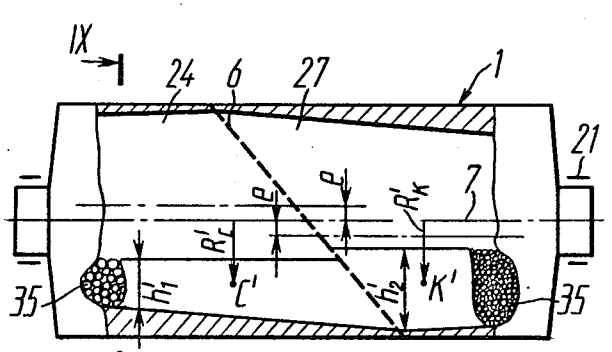
FIG. 7 shows the same ball tube mill modification as shown in FIG. 6 in the position of the housing of the mill turned 180°.
Figure 6:
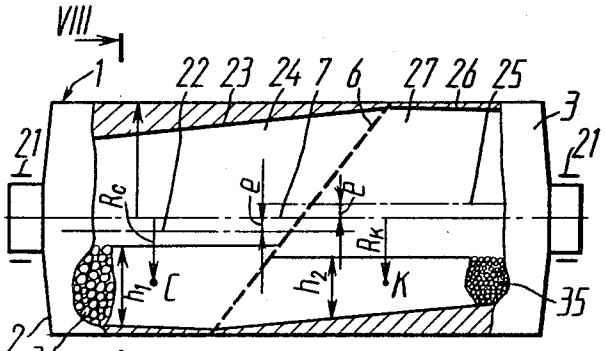
FIG. 6 shows a ball tube mill in which the lined inside surface is offset relative to the longitudinal axis of the housing.
Figure 9:
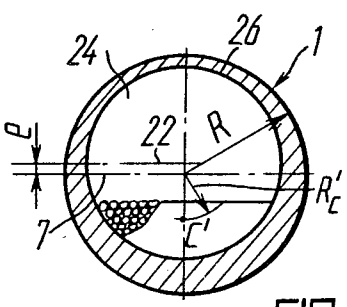
FIG. 9 is a section taken along the line IX—IX in FIG. 7.
Figure 8:
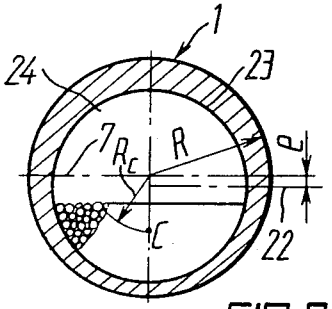
FIG. 8 is a section taken along the line VIII—VIII in FIG. 6.

FIGS. 7 and 9 represent the position of the ball tube mill turned 180° relative to the position of the mill illustrated in FIGS. 6 and 8.

For attaining a still higher efficiency of the grinding process when using balls and cylinders as the grinding bodies a chamber 28 of medium size grinding (FIG. 10) has a vertical annular perforated wall plate 29 (FIGS. 10 and 11) the central part of which is provided with a hole 30. Perforations 31 occupy the entire surface area of the annular wall plate 29, and particles of the material being comminuted pass through these perforations 31.

The annular perforated wall plate 29 is secured at a distance L of not more than one diameter D of the housing 1 from the perforated wall 6 at the side of the shorter part of the chamber 28. The diameter d of the inner hole 30 of the annular perforated wall plate 29 amounts to 0.2–0.4 the diameter D of the housing 1 of the ball tube mill according to the invention.

Balls are charged into a coarse grinding chamber 32 and into the medium size grinding chamber 28; whereas the fine grinding chamber 33 is charged with cylindrical grinding bodies.

The ball tube mill according to the invention operates in the following manner.

The material to be comminuted is fed through the inlet hole 4 to the chamber 8. During rotation of the housing 1 of the proposed mill the perforated wall 6 occupies successively characteristic positions A and B represented, respectively, in FIGS. 1 and 2. In the position A of the perforated wall 6 the length of the lower working portion of the coarse grinding chamber 8 is minimal, and that of the fine grinding chamber 9 is maximal.

In the position B of the perforated wall 6 the length of the lower working portion of the coarse grinding chamber 8 grows to the maximal (increases by a magnitude $l=D/tg\alpha$, where D is the inside diameter of the housing of the mill, and $\alpha$ is the angle of inclination of the perforated wall 6 to the longitudinal axis 7); whereas the length of the lower working portion of the fine grinding chamber 9 diminishes to the minimal (reduces by a magnitude $l=D/tg\alpha$).

When passing from the position B to the position A the perforated wall 6 scoops the grinding bodies present under the perforated wall 6 at the portion l in the coarse grinding chamber 8, raises them to an angle 85°-90°, and throws them along the longitudinal axis 7 of the housing 1 toward the cover plate 2. When falling down the grinding bodies act to comminute the particles of the material by vigorous impact, crushing and attrition.

At the same time the length of the lower working portion of the fine grinding chamber 9 increases by a magnitude l, whereby the grinding bodies roll to under the perforated wall 6 along the inclined tapered lining 11 and lengthwise of the generating line 13 to occupy the free portion l of the chamber 9. In this case particles of the material are comminuted by attrition under the action of the grinding bodies moving both along and transversely of the longitudinal axis 7 of the housing 1 of the mill.

During a subsequent rotation of the housing 1 of the mill the perforated wall 6 passes from the position A to the position B. Therewith, the length of the lower working portion of the coarse grinding chamber 8 grows to the maximal (increases by the value of l). The grinding bodies are caused to roll along the generating line 12 of the tapered lining 10 to under the perforated wall 6 at the portion l to grind the particles of the material by vigorous attrition.

At the same time the perforated wall 6 acts to scoop the grinding bodies present at the portion l in the chamber 9 and throw them along the longitudinal axis 7 toward the cover plate 3 thus effecting grinding by impact, whereupon the cycle is repeated.

The finished product is evacuated from the mill through the discharge hole 5.

The lined inside surface of the chambers 8 and 9 in the form of truncated cones 10, 11 facing by their large bases the perforated wall 6 provides more favourable conditions for the vigorous movement of the grinding bodies along the axis 7 of the housing 1 inside the chamber 8 from the cover plate 2 to under the perforated wall 6, and in the chamber 9 from the cover plate 3 to under the perforated wall 6. The perforated wall 6 acts to force the grinding bodies toward the cover plate 2 and cover plate 3 along the longitudinal axis 7 of the housing 1 of the mill.

The grinding bodies in each of the chambers 8 and 9 assume such a position in which their surface (not shown) rests at an angle equal to the angle $\delta$, $\beta$ of slope of the grinding bodies present in the chamber, i.e., the surface of the grinding bodies is inclined in the same direction as the perforated wall 6. Because the angle $\delta$, $\beta$ of inclination of the generating lines 12, 13 equals the angle of slope of the grinding bodies, the grinding bodies (ball shaped) are disturbed from the longitudinal equilibrium to roll along the longitudinal axis 7 of the housing 1 toward the perforated wall 6 and occupy uniformly the working volume of the chambers 8 and 9 at the portion l.

When the angles $\delta$ and $\beta$ of inclination of the generating lines 12 and 13 of the truncated cones 10 and 11 are smaller than the angle of slope of the grinding bodies present, respectively, in the chambers 8 and 9, the grinding bodies, while moving along the longitudinal axis 7 of the housing 1, fail to reach the perforated wall 6 at the portion l of the housing 1.

Due to the aforedescribed, the volumes of the chambers 8 and 9 of the housing 1 of the mill are not fully utilized, which affects the efficiency of the grinding process.

Because the chambers 8 and 9 of the housing 1 of the mill are charged with grinding bodies having different angles of slope, the generating lines 12 and 13 of the truncated cones have different angles $\delta$ and $\beta$ of inclination.

If the lined inside surface of each of the chambers 8 and 9 is defined by the tapered circular portions 14 and 16, the longitudinal movement of the grinding bodies from the cover plates 2 and 3 toward the perforated wall 6 is envigorated. This in turn results in a more efficient grinding process.

As the angles $\delta_1$ and $\beta_1$ of inclination of the generating lines 15 and 17 of the circular tapered portions 14 and 16 grow, the longitudinal travel of the grinding bodies from the cover plates 2 and 3 to the perforated wall 6 is invigorated, whereas with the reduction of the angles $\delta_1$ and $\beta_1$ the movement of the grinding bodies is slowed down, and consequently the grinding process becomes less efficient.

The volume of the coarse grinding chamber 8 is preferably smaller than that of the fine grinding chamber. The reason for this preference lies in the following. The coarse grinding chamber 8 receives through the inlet hole 4 the initial product particles of which have structural defects (viz., microcracks, pores, easily grindable inclusions) to require a smaller amount of work for their comminution.

Particles of the material with minimized structural defects pass from the chamber 8 through the perforated wall 6 to the chamber 9 to necessitate a greater amount of work for their comminution. In consequence, the subsequent grinding of the material in the chamber 9 requires more work, which necessitates a greater mass (quantity) of the grinding bodies. Accordingly, the volume of the chamber 9 should be greater than that of the chamber 8.

The modified ball tube mill having projections 19 (FIG. 3) and 20 on the inner surface of the lining operates in the following manner with respect to the chamber **8*b*. During rotation of the housing 1, particularly in the position thereof shown in FIG. 3, the chamber 8*b* has the minimal length $l_1$ with the grinding bodies present therein occupying the maximum level ensuring cascade operation of the grinding bodies. In this position the shorter portion of the chamber 8*b* has a smooth surface free of projections. A subsequent rotation causes the perforated wall 6 to assume the position indicated at 6*a*. During the passage of the perforated wall from the position 6 to the position 6*a* the grinding bodies are scooped by this wall to be raised to an angle 85°-90°, dumped down along the longitudinal axis 7 of the housing 1**, and comminute the material.

In the position **6*a* assumed by the perforated wall 6 the length of the lower working portion of the chamber 8 grows by $l=D/tg\alpha$. The level of the grinding bodies present in the chamber 8b** is therefore reduced to the minimum.

In this position the projections 19 on the lined surface assume the low position (not shown in FIG. 3).

During a subsequent rotation of the housing 1 of the mill the grinding bodies scooped by the projections 19, raised to an angle 85°–90° and dumped along the longitudinal axis 7 of the housing 1 thus comminuting the material, after which the cycle is repeated.

The grinding bodies present in the chamber 9 function in a similar manner, the difference being in that their movement is displaced in phase by 180°.

The end product is evacuated from the housing of the mill through the discharge hole 5.

When the volume of the coarse grinding chamber 8 is equal to or greater than the volume of the chamber 9, the production capacity of the chamber 8 tends to be higher than that of the chamber 9 to result in that an excess amount of the material being comminuted is admitted to the chamber 9, which affects the grinding process efficiency.

In the course of operation of the ball tube mill, by virtue of the fact that the mass of the grinding bodies present in the chambers 24, 27 remains invariable, while the length of the lower working portion of each of the chambers 24, 27 varies during the cycle from the minimal to the maximal, the position of the center of the mass of the grinding bodies relative to the longitudinal axis 7 of the housing 1 (FIGS. 6 to 9) also varies.

In order to stabilize the amount of loads exerted on the support bearings 21, the lining of the inside surface is preferably fashioned as illustrated in FIGS. 6 to 9.

The lining of the housing 1 (FIG. 6) is materialized in the following manner.

In the position of the housing 1 and perforated wall 6 shown in FIG. 6 and FIG. 8 the height of the layer of the grinding bodies 34 in the chamber 24 is maximal, equal to $h_1$. The center C of gravity of the grinding bodies 34 is spaced at a distance $R_c$ from the longitudinal axis 7 (axis of rotation) of the housing 1.

At the same time the grinding bodies 35 present in the chamber 27 have a minimum layer height $h_2$, whereas the distance from the longitudinal axis 7 of the housing 1 to the center K of gravity of the grinding bodies 35 inside the chamber 27 is $R_k$.

During rotation of the housing 1, particularly after half a revolution, the perforated wall 6 assumes a position represented in FIG. 7.

The length of the lower working portion of the chamber 24 grows to the maximal. The height $h_1'$ of the grinding bodies 34 present in the chamber 24 reduces to the minimal. The center C of gravity of the grinding bodies inside the chamber 24 is displaced to a position indicated at $R_c'$. Therewith, in this position of the housing 1 (FIG. 7) the grinding bodies lie over the longer part of the chamber 24 of a greater thickness. For this reason, the distance $R_c'$ between the center C' of gravity of the grinding bodies present in the chamber 24 and the longitudinal axis 7 in the position of the housing 1 shown in FIG. 7 will be the same as the distance $R_c$ in the position of the housing 1 illustrated in FIG. 6. Consequently, the torque will be of the same magnitude throughout the cycle to result in invariable loads exerted on the bearings 21.

The grinding bodies present in the chamber 27 will move in a substantially likewise manner. In the position of the housing 1 shown in FIG. 7 the length of the lower working portion of the chamber 27 is reduced to the minimal. The height $h_2'$ of the layer of the grinding bodies 35 present in the chamber 27 grows to the maximum. The center of gravity of the grinding bodies 35 present inside the chamber 27 displaces to a position K'. The distance $R_k'$ from the center K' of gravity to the longitudinal axis 7 remains the same, since the grinding bodies 35 in this position of the housing 1 lie on part of the lining of the truncated cone 26 of a minimal thickness. During the movement of the grinding bodies 35 in the chamber 27 through the cycle the torque remains invariable in magnitude. Therefore, the loads exerted on the bearings 21 remain constant through the cycle.

If the longitudinal axes 22 and 25 of the truncated cones 23 and 26 coincide with the longitudinal axis 7 of the housing 1 (as has been described with reference to previous modifications) the lining of the longer and shorter portions of the chambers 24 and 27 will have the same thickness.

Since within the cycle the height h of the layer of the grinding bodies in each of the chambers varies, then the distance $R_c$ and $R_k$ from the center of the mass of the grinding bodies to the longitudinal axis 7 changes to consequently result in variations in the magnitude of the torque and loads exerted on the bearings 21.

Figure 10:
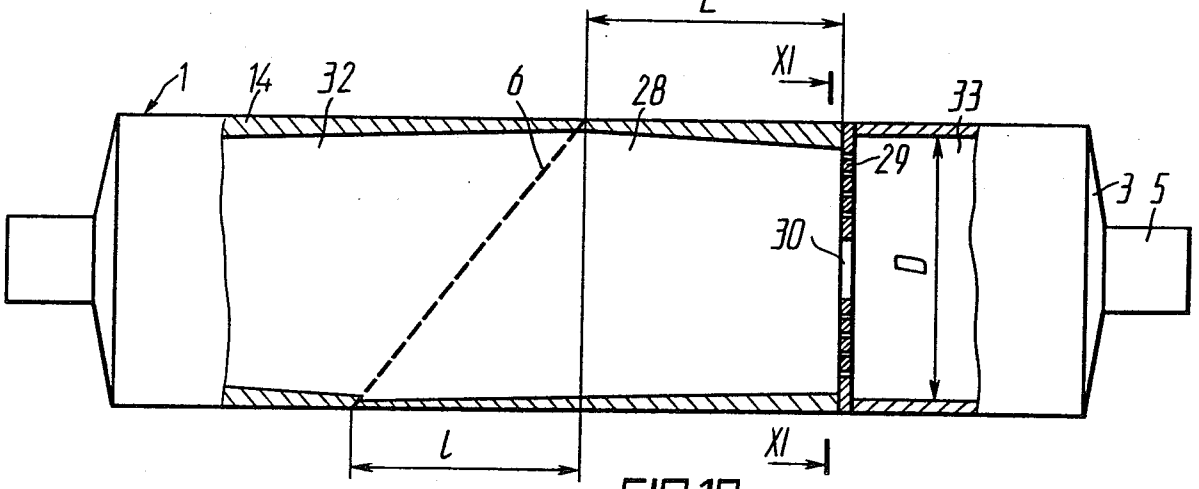
FIG. 10 is a longitudinal sectional view of a ball tube mill with a perforated annular wall plate.
Figure 11:
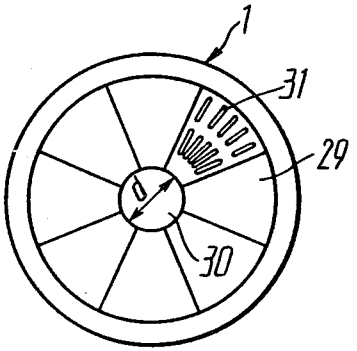
FIG. 11 is a section taken along the line XI—XI in FIG. 10.

When making use of grinding bodies of different shape, such as balls and cylinders, the ball tube mill is preferably embodied as represented in FIG. 10 and operates as follows.

Figure 2:
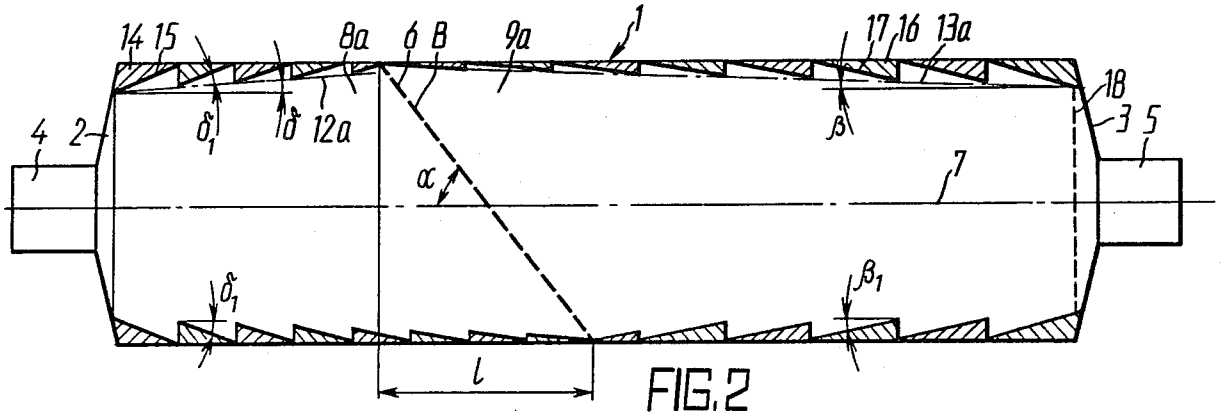
FIG. 2 is a longitudinal sectional view of a ball tube mill where the lined inside surface of each grinding chamber is defined by separate portions.

During rotation of the housing 1 of the mill the grinding bodies (balls) present in the chambers 32 and 28 at both sides of the perforated wall 6 function in a manner substantially similar to what has been described with reference to FIGS. 1 and 2. The grinding bodies (cylinders) present in the chamber 33 are caused to be raised by the centrifugal force to an angle 40°–50°, roll on the slope surface, and grind the material by crushing and attrition. The finished product is evacuated from the chamber 33 through the discharge hole 5 in the cover plate 3. Therewith, the grinding bodies inside the chambers 32 and 28 execute transverse and longitudinal movement, and only transverse movement in the chamber 33.

The diameter d of the inner hole 30 of the perforated wall plate 29 equal to (0.2–0.4) D prevents the passage of the cylinders from the chamber 33 to the chamber 28, and of the balls from the chamber 28 to the chamber 33 at the charge of the chambers 28, 33 with the grinding bodies amounting to 0.3–0.4 of their volume. With an increase in the diameter d of the hole 30 to 0.45 D or even more the grinding bodies pass from the chamber 28 to the chamber 33 and vice versa. As a result, the grinding bodies present in the adjacent chambers 28 and 33 tend to mix, whereby the efficiency of the grinding process is reduced.

If the diameter d of the hole 30 is less than 0.2 D, the free cross-sectional area of the perforated annular wall plate 29 grows smaller, hydraulic resistance of the mill increases, and suction conditions become less favourable, which affects the grinding process efficiency.

Reducing the length L between the perforated annular wall plate 29 and perforated wall 6 causes higher axial loads acting from the side of the chamber 28 on the perforated annular wall plate 29, which makes this wall plate 29 less reliable in operation. With an increase in the distance between the perforated annular wall plate 29 and perforated wall 6 the length of the fine grinding chamber 33 becomes shorter, and the mass of the grinding bodies (cylinders) present therein reduces, whereby the grinding process becomes less efficient and the quality of the finished product is downgraded.

When the housing 1 of the mill having a perforated wall 6 is not provided with the perforated annular wall plate, and use is made of cylindrical grinding bodies in one of the chambers, the efficiency of the grinding process drops sharply.

This is accounted for by the following. The cylinders have a rather high angle of slope and consequently a lower longitudinal mobility. During rotation of the housing 1 the cylinders fail to move to the space under the perforated wall, the working volume of the chamber is not fully utilized, and grinding becomes less efficient.

In view of the aforedescribed, by invigorating the longitudinal movement of the grinding bodies, utilizing the volume of the chambers in a more rational manner, and stabilizing the working conditions for the grinding bodies transversely and longitudinally of the housing of the mill, it is possible to attain a higher efficiency of the grinding process and reduce the amount of power consumed for each unit of the end product.

What is claimed is:

1. A ball tube mill comprising:

a housing with a lined inside surface;

means for rotating said housing;

a first end wall at one end of said housing provided with an inlet hole;

a second end wall at the other end of said housing provided with an outlet hole in said second end wall;

grinding bodies, said housing including coarse and fine grinding chambers charged with said grinding bodies; and at least one perforated wall arranged at an angle to the longitudinal axis of said housing and dividing the housing into said coarse and fine grinding chambers, the lined inside surfaces of said chambers having the form of truncated cones having their large bases facing said perforated wall, the angle of inclination of a generating line of the truncated cones equalling the angle of slope of said grinding bodies present in the respective chamber, the volume of said coarse grinding chamber being smaller than the volume of said fine grinding chamber.

2. A ball tube mill as defined in claim 1, in which the lined inside surface of each grinding chamber is defined by successively arranged portions with the inclination angle of a generating line of each such portion being greater than the angle of slope of the grinding bodies present on the respective portion, each successive portion forming with the preceding portion a ledge, whereas the angle of inclination of a common generating line of the portions is substantially equal to the angle of slope of the grinding bodies present in the respective chamber.

3. A ball tube mill as defined in claim 1 or 2, wherein the lined inside surface of said housing has projections extending in an axial direction, lengthwise of each part of said chambers and circumferentially the projections extend at half of the length of the circle of each of said chambers.

4. A ball tube mill as defined in claim 1, in which an axis of symmetry of the lined inside surface of each grinding chamber is offset relative to the longitudinal axis of the housing toward the shorter portion of the respective chamber.

5. A ball tube mill as defined in claim 1, in which the fine grinding chamber accommodates a vertical annular perforated wall plate spaced at a distance of not more than one diameter of the housing from the perforated wall at the side of the shorter portion of this chamber, whereas the diameter of an inside hole in the annular perforated wall plate amounts to 0.2–0.4 the diameter of the housing.

* * * * *